United States Patent [19]

Schmid

[11] Patent Number: 4,628,419

[45] Date of Patent: Dec. 9, 1986

[54] SIGNAL LAMP

[75] Inventor: Willi Schmid, Fislisbach, Switzerland

[73] Assignee: W. Schmid AG, Fislisbach, Switzerland

[21] Appl. No.: 638,887

[22] Filed: Aug. 8, 1984

[30] Foreign Application Priority Data

Aug. 9, 1983 [CH] Switzerland ..... 4322/83

[51] Int. Cl.[4] ..... F21V 3/00

[52] U.S. Cl. ..... 362/145; 362/249; 362/368; 362/457; 362/800

[58] Field of Search ..... 362/800, 145, 368, 457, 362/249

[56] References Cited

U.S. PATENT DOCUMENTS

| | | | |
|---|---|---|---|
| 4,195,330 | 3/1980 | Savage | 362/800 |
| 4,363,087 | 12/1982 | Graham et al. | 362/800 |
| 4,398,240 | 8/1983 | Savage | 362/800 |
| 4,419,722 | 12/1983 | Bury | 362/800 |
| 4,445,164 | 4/1984 | Giles, III et al. | 362/800 |
| 4,471,414 | 9/1984 | Savage | 362/800 |

*Primary Examiner*—Ira S. Lazarus
*Attorney, Agent, or Firm*—Peter K. Kontler

[57] ABSTRACT

A signal lamp whose frustoconical or frustopyramidal housing contains a square or cylindrical light emitting diode and has a rear wall which is completely surrounded by an endless rear edge portion of the sidewall of the housing. The rear wall constitutes or is disposed behind a plate-like carrier for the diode and one or more series resistors, and such rear wall can be bonded directly to the front side of the front wall of a switch box, control panel or the like. The front end of the housing has a square or rectangular aperture for the front wall of the light-transmitting envelope of the diode. The conductors which connect the diode to an energy source pass through one or more hollow projections which extend from the rear wall of the housing and through one or more complementary openings of the front wall. At least one of the projections can have external threads to mate with a nut which is located behind the front wall and urges the adhesive-coated rear side of the rear wall of the housing against the respective side of the front wall.

11 Claims, 6 Drawing Figures

SIGNAL LAMP

BACKGROUND OF THE INVENTION

The present invention relates to signal lamps in general, and more particularly to improvements in signal lamps which employ light sources in the form of light emitting diodes. Still more particularly, the invention relates to improvements in signal lamps of the type wherein the light emitting diode is confined in a housing whose front end portion transmits light.

It is already known to install a light emitting diode on a plate-like carrier which is mounted in the housing of the signal lamp and which further supports one or more series resistors. The plate-like carrier normally extends at least substantially at right angles to the axis of the housing of the lamp. Reference may be had to commonly owned copending patent application Ser. No. 553,757 filed Nov. 21, 1983 for "Signal lamp with light emitting diode" and to commonly owned copending patent application Ser. No. 618,217 filed June 7, 1984 now abandoned for "Adapter for attachment of light emitting devices to control panels and the like". A drawback of the just discussed previously disclosed signal lamps is that their mounting on the front wall of a control panel or the like invariably necessitates the making of relatively large openings whose dimensions match or even exceed those of the housing for the diode. The housing is inserted into and held in the respective opening by detent means, preferably in such a way that only a very thin frame-like portion of the housing extends forwardly beyond the front side of the control panel.

OBJECTS AND SUMMARY OF THE INVENTION

An object of the invention is to provide a signal lamp whose housing can be mounted on a control panel or the like in a simple, inexpensive and reliable way without the need for the making of large openings in the control panel.

Another object of the invention is to provide a novel and improved housing for use in a signal lamp of the above outlined character.

A further object of the invention is to provide a signal lamp whose housing can be permanently or separably secured to its support in a time- and material-saving way.

An additional object of the invention is to provide a signal lamp which can be used as a superior substitute for heretofore known signal lamps.

Still another object of the invention is to provide a novel and improved method of securing the housing of a signal lamp to its support.

An additional object of the invention is to provide a signal lamp which can be furnished in any desired size and/or shape and at least a portion of which can be used as a push or press switch.

Another object of the invention is to provide a switch which embodies the above outlined signal lamp.

One feature of the invention resides in the provision of a combination of elements including a support, e.g., a plate-like portion of a control panel or the like, and a signal lamp comprising a housing which includes a front portion with an aperture therein, a rear portion and a rear side in the region of the rear portion. The improved structure further comprises means for securing the housing to the support and, in accordance with a feature of the invention, such securing means is provided at the rear side of the housing so that the entire housing is located in front of (rather than being embedded in) the support. The combination further comprises a light emitting diode in the housing behind the aperture. The housing preferably comprises a circumferentially complete hollow (e.g., frustopyramidal or frustoconical) sidewall and the rear portion of the housing preferably constitutes an endless portion forming part of the sidewall and surrounding the rear side of the housing. A carrier for the diode and one or more series resistors can be provided in the housing in front of a rear wall which defines the rear side of the housing. Alternatively, the rear wall can constitute a carrier for the diode and one or more resistors. The rear edge face of the endless rear portion of the sidewall is preferably at least substantially flush with the rear side of the rear wall of the housing.

The securing means can comprise a layer of adhesive on the rear wall so that the outer side of the rear wall is directly bonded to the front side of the support. Alternatively or in addition to such adhesive layer at the rear side of the rear wall, the securing means can comprise one or more preferably hollow projections which extend rearwardly from the rear side of the rear wall of the housing and through one or more complementary openings of the support. Such projection or projections can define passages for conductors which connect the diode with an energy source and/or they can be provided with external threads to mesh with nuts at the rear side of the support to thereby urge the rear side of the rear wall of the housing against the front side of the support. The projection or projections of the rear wall of the housing are preferably parallel or nearly parallel to the axis of the sidewall.

A light-transmitting member can be installed in the aperture in the front portion of the housing, and such light transmitting member is or can be constituted by a light-transmitting portion of the envelope of the light emitting diode.

The housing can be provided with several apertures of identical or different size and/or shape and then contains a discrete light emitting diode behind each such aperture. A common carrier (e.g., the rear wall of the housing) can be provided for all diodes in the housing.

Another feature of the invention resides in the provision of a press switch which comprises a housing and a pushbutton which is reciprocably mounted in the housing and is accessible from the outside of the housing. In accordance with a feature of the invention, the pushbutton contains or is constituted by a light emitting diode. The switch preferably further comprises a reciprocable pusher which is installed in the housing and supports the pushbutton. The latter is preferably surrounded by and is reciprocable relative to an annular (e.g., cylindrical or polygonal) portion of the housing. The front portion of the pusher can support a plate-like carrier for the diode, and such carrier can be separably mounted on the pusher. An at least substantially flat portion of the light transmitting envelope of the diode is preferably accessible for depression of the pushbutton.

The novel features which are considered as characteristic of the invention are set forth in particular in the appended claims. The improved signal lamp itself, however, both as to its construction and the mode of assembling the same, together with additional features and advantages thereof, will be best understood upon perusal of the following detailed description of certain specific embodiments with reference to the accompanying drawing.

DESCRIPTION OF THE PREFERRED EMBODIMENTS

Figure 1:
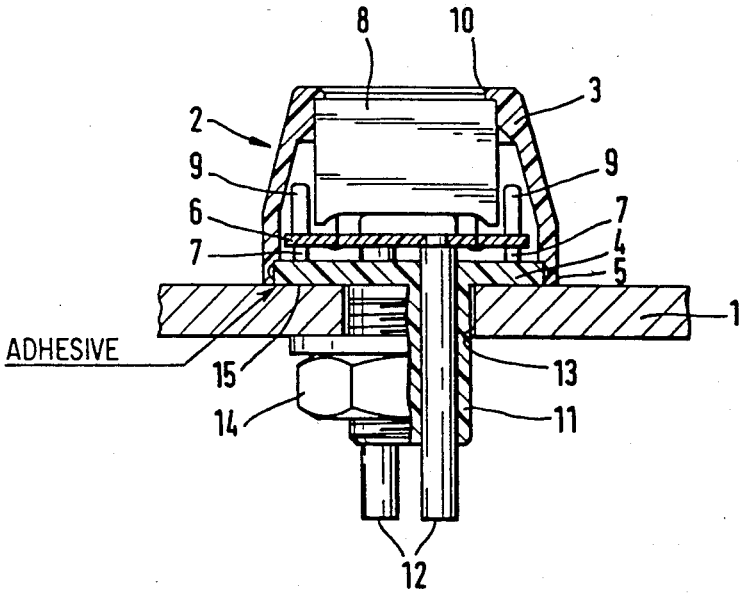
FIG. 1 is a partly elevational and partly central sectional view of a signal lamp which embodies one form of the invention and has a round aperture in the front end of the frustoconical sidewall of its housing.
Figure 2:
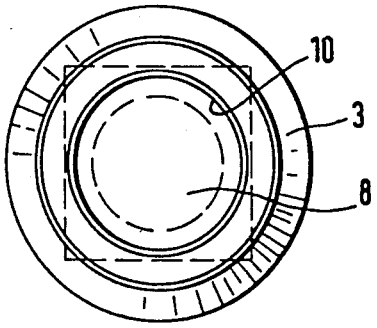
FIG. 2 is a plan view of the signal lamp of FIG. 1, with the support for the rear wall of the housing omitted.

Referring first to FIG. 1, the reference character 1 denotes the front wall or support of a switch box or control panel which supports a signal lamp 2 embodying one form of the present invention. The signal lamp 2 comprises a housing or casing which has a slightly frustoconical outwardly tapering circumferentially complete sidewall 3. The larger-diameter rear end of the sidewall 3 contains a plate-like rear wall or bottom wall 4 which is held therein by snap action or otherwise. The rear or bottom wall 4 is surrounded by a circumferentially complete endless rear edge portion 5 of the sidewall 3 of the housing. A plate-like carrier 6 of conductor means is installed in the housing of the signal lamp 2 in front of and in parallelism with the rear wall 4. Distancing elements 7 are provided to maintain the carrier 6 in at least substantial parallelism with the rear wall 4. The front side of the plate-like carrier 6 is secured to a light emitting diode 8 which is connected thereto by soldering or in another suitable way, and the diode 8 is flanked by two series resistors 9 which are also soldered to the front side of the carrier 6. The light emitting diode 8 comprises a substantially block-shaped or cubical enclosure or envelope which transmits light and a portion of which is immediately or closely adjacent to a light-transmitting aperture 10 in the front end portion of the frustoconical sidewall 3. The aperture 10 of the sidewall 3 which is shown in FIGS. 1 and 2 is round or substantially round.

The outer or rear side 15 of the rear or bottom wall 4 of the housing of the signal lamp 2 is provided with a centrally located rearwardly extending hollow projection 11 in the form of a stud or post which provides a path for the two conductors 12 by means of which the diode 8 is connected with an energy source, not shown. The projection 11 extends through an opening 13 in the support 1 and is externally threaded to take a nut 14 which urges the rear wall 4 of the housing of the signal lamp 2 against the front side of the support 1. The external threads on the projection 11 and the nut 14 can be omitted if the rear or outer side 15 of the rear or bottom wall 4 of the housing of the signal lamp 2 is coated with a suitable adhesive (indicated by a legend) so that the rear wall 4 is bonded to the support 1. For example, the layer of adhesive which is applied to the rear side 15 of the rear wall 4 can be of the type which is responsive to pressure, such as the pressure which is applied thereto by tightening the nut 14 so that the rear side 15 of the wall 4 is biased against the front side of the support 1.

In order to keep the height of the housing of the signal lamp 2 to a minimum, it is possible to omit the carrier 6 and to use the rear wall 4 as a carrier for the diode 8 and resistor means 9. This reduces the overall height of the signal lamp by the thickness of the carrier 6 and the length of the distancing elements 7.

Figure 3:
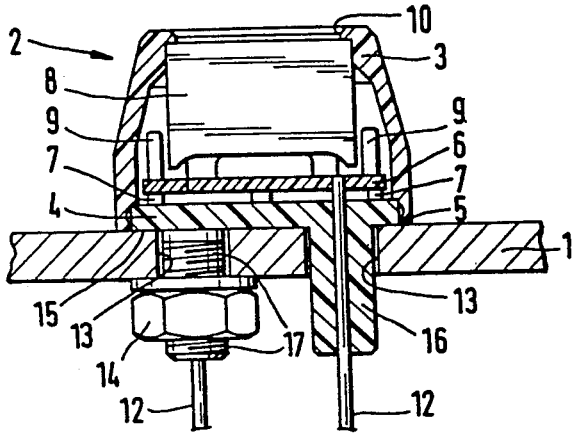
FIG. 3 is a partly elevational and partly central sectional view of a second signal lamp which employs a light emitting diode having a block-shaped envelope and being installed in a frustopyramidal housing.
Figure 4:
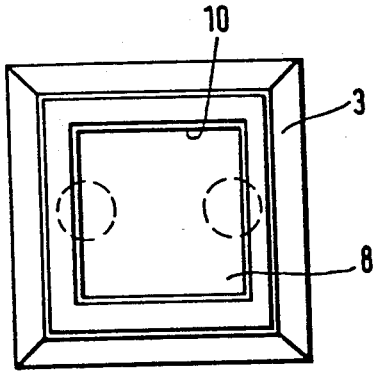
FIG. 4 is a plan view of the second signal lamp, with the support for the rear wall of the housing omitted.

FIGS. 3 and 4 illustrate a modified signal lamp 2 wherein the light-transmitting aperture 10 in the front end portion of the circumferentially complete frustopyramidal sidewall 3 of the housing of the signal lamp has a polygonal (preferably a square or rectangular) outline. All such parts of the structure which is shown in FIGS. 3 and 4 which are identical with or clearly analogous to the corresponding parts of the structure of FIGS. 1 and 2 are denoted by similar reference characters. The signal hollow projection 11 of the single lamp 2 of FIGS. 1 and 2 is replaced with two discrete projections 16 and 17 each of which defines a passage for a discrete conductor 12. If the housing of the signal lamp 2 which is shown in FIGS. 3 and 4 is to be secured to the support 1, it suffices to provide external threads on one of the projections 16, 17 and to utilize a nut 14 which meshes with the externally threaded projection and urges the rear or outer side 15 of the rear wall 4 of the housing against the front side of the support 1. In addition to or in lieu of the nut 14, the signal lamp 2 of FIGS. 3 and 4 can have a layer of adhesive applied to the rear side 15 of the rear wall 4 so that the housing of this signal lamp is bonded to the front side of the support 1. The opening or openings 13 in the support 1 can be made with a drilling tool or in any other suitable way.

An important advantage of the improved signal lamp 2 is that it can be secured to its support 1 in a surprisingly simple and reliable way, either permanently or removably, and that such attachment of the housing of the signal lamp to its support does not necessitate the making of large openings in the support. In other words, the diameter of each opening 13 in the support 1 can be a small fraction of the diameter of the rear wall 4 of the signal lamp 2 shown in FIGS. 1–2 or a small fraction of the length of one side of the polygonal rear wall 4 in the housing of the signal lamp 2 which is shown in FIGS. 3 and 4. Also, there is no need to provide the support 1 with specially designed detent means in the form of claws, jaws or the like in order to hold the housing of the signal lamp 2 in requisite position. The opening or openings 13 can be machined with resort to simple and readily available tools, and the extent of material removal from the support 1 is negligible in comparison with that in constructions wherein the entire housing of the signal lamp must be fitted into its support.

The rear face of the edge portion 5 of the sidewall 3 of the improved housing is preferably flush with the exposed rear side 15 of the rear wall 4. The rear wall 4 is fitted into the rear edge portion 5 subsequent to introduction of the diode 8 and its carrier 6 into the interior of the housing, and the layer of adhesive can be applied to the rear side 15 of the rear wall 4 in the manufacturing plant so that it is merely necessary to activate the adhesive in order to ensure the establishment of an adequate bond between the support 1 and the rear wall 4. The conductors 12 are pushed through the projection or projections of the rear wall 4 prior or subsequent to insertion of such projection or projections into the respective opening or openings 13 of the support 1. Simple bonding of the rear wall 4 to the front side of the support entails substantial savings in the cost of making the signal lamp and in the cost of making the support therefor as well as in the assembly cost.

The adhesive layer on the rear side 15 of the rear wall 4 of the housing is desirable and advantageous but is optional nevertheless. This is due to the fact that, if the rear wall 4 carries one or more hollow projections (11 or 16, 17), such projection or projections can cooperate with one or more nuts 14 to reliably hold the rear side 15 of the wall 4 in contact or in a position of abutment with the front side of the support 1. The reliability of connection between the housing of the signal lamp 2 and the support 1 can be enhanced considerably by utilizing the layer of adhesive at the exposed side 15 of the rear wall 4 and by also employing one or more nuts 14 in mesh with the externally threaded portion(s) of one or more hollow projections of the rear wall 4. As a rule, one will first bond the rear side 15 to the front side of the support 1, and the nut or nuts 14 are applied in the next step. This enables a single operator to attach the housing to a control panel or the like because the adhesive layer bonds the rear wall 4 to the support 1 while the operator proceeds to apply and tighten one or more nuts 14.

As mentioned above, compactness of the improved signal lamp 2 can be enhanced if the rear wall 4 performs the function of the carrier 6. This is shown in FIG. 5.

Figure 6:
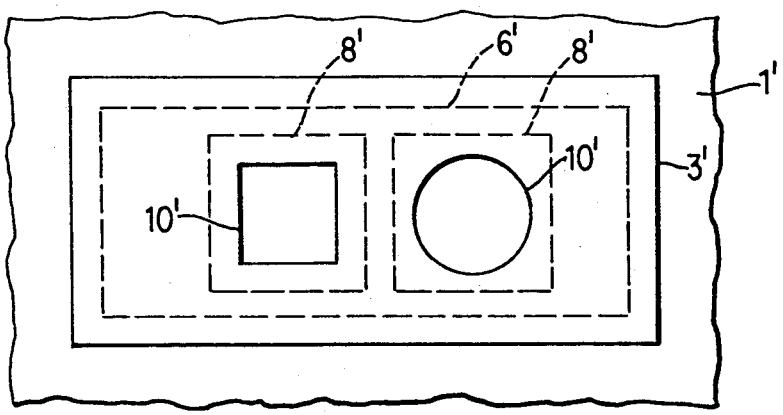
FIG. 6 is a schematic plan view of a further signal lamp with several diodes.

A modified signal lamp is shown schematically in FIG. 6. The support 1' carries a housing including a circumferentially complete sidewall 3' with a round aperture 10' and a square aperture 10'. A discrete light emitting diode 8' is installed in the housing which includes the sidewall 3' behind each of the apertures 10' so that the front portion of the envelope of the diode constitutes a light-transmitting plate in or immediately adjacent to the respective aperture 10'. The diodes 8' are mounted on a common carrier 6' which is installed in the interior of the housing and can constitute the rear wall of such housing. The structure of FIG. 6 can have more than two apertures 10' for an equal number of light emitting diodes 8'.

Figure 5:
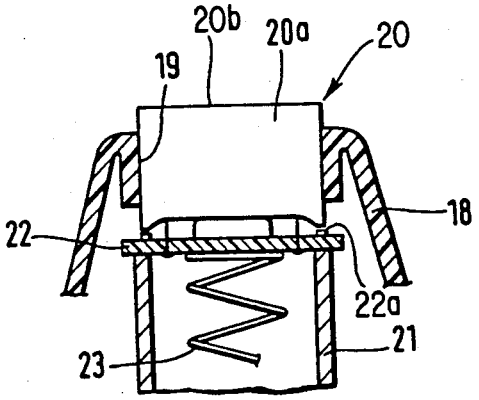
FIG. 5 is a fragmentary axial sectional view of a signal lamp which constitutes a push or press switch and has a reciprocable light emitting diode.

FIG. 5 shows a push or press switch which has a housing 18. The illustrated front section of this housing constitutes a forwardly tapering frustoconical sleeve having at its front end an inwardly extending annular portion 19 which can have a round or a polygonal (e.g., square) outline and surrounds a portion of the light-transmitting envelope **20*a* of a light emitting diode 20. The envelope 20*a* of the diode 20 has a cylindrical or polygonal shape, depending on the cross-sectional outline of the aperture which is defined therefor by the annular portion 19 of the housing 18**.

The rear section of the housing 18 contains a reciprocable pusher 21 having at its front end a transversely extending plate-like conductor carrier 22 which supports the diode 20. The latter constitutes a pushbutton of the illustrated switch and can be depressed with the pusher 21 and its carrier 22 against the opposition of a coil spring 23 which bears against the rear or inner side of the carrier 22. The remaining components of the switch form no part of the invention. Such remaining components can be constructed and assembled in a manner as disclosed, for example, in German Auslegeschrift No. 1,290,620. The arrangement may be such that the diode 20 begins to transmit light in response to its depression into the housing 18 against the opposition of the spring 23 or that it begins to transmit light in response to depression and subsequent return movement to the illustrated non-depressed position. It has been found that the signal which is generated as a result of transmission of light by the reciprocable diode 20 or as a result of termination of transmission of light by such reciprocable diode can be detected much more readily than in presently known push or press switches.

The envelope **20*a* of the diode 20 has a flat or substantially flat front portion or wall 20*b* which is accessible to a finger for depression of the pushbutton which includes or is constituted by the diode 20. Also, the carrier 22 is or can be separable from the remainder of the reciprocable pusher. For example, the carrier 22 can be secured to the front end portion of the remainder of the pusher 21 by screws 22*a*, clips or analogous fasteners. Cooperating male and female connecting means can be used in lieu of screws 22*a* to separably secure the carrier 22 to the pusher 21. All this renders it possible to replace a defective pushbutton (diode 20) and its carrier 22** with a fresh unit.

A drawback of the press switch which is disclosed in the aforementioned German publication is that the front part of the housing contains a light-transmitting plate in front of the light emitting diode. Such plate absorbs a substantial amount of light so that the signals which are generated in response to transmission or cessation of transmission of light by the diode are weakened due to the presence of a plate in front of the diode. In the improved press switch which is shown in FIG. 5, the envelope **20*a* of the diode 20 is accessible in front of the housing 18, at least in undepressed condition of the diode, so that the intensity of light which is emitted by such diode is not affected by partially or even strongly light-transmitting means in front of the diode. In other words, the diode 20 is the pushbutton of the switch and, therefore, its condition (i.e., whether or not it emits light) can be ascertained much more readily than in the aforedescribed conventional push switches. The diode 8 or 20** may be of the commercially available type which also contributes to lower cost of the improved signal lamp and/or press switch.

Another important advantage of each of the illustrated embodiments is that the height of the housing of the signal lamp or switch is a fraction of that in a conventional device which is very important in many types of signal transmitting or generating systems.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. The combination of a support, such as a control panel, having a front side, with a signal lamp comprising a housing including a front portion having an aperture disposed in a predetermined plane, a rear portion, a substantially flat rear side located in the region of said rear portion and disposed in front of said support, and a carrier which is at least substantially parallel to said plane and to said rear side, means for securing said housing to said support, said securing means being disposed in the region of, and including an adhesive coating on, said rear side, a light emitting diode mounted on said carrier behind said aperture and confined in said housing substantially in its entirety, and conductor means connected with said diode and extending from said housing through said rear side and adhesive coating.

2. The combination of claim 1, wherein said housing comprises a circumferentially complete sidewall and said rear portion is an endless portion forming part of said sidewall and surrounding said rear side.

3. The combination of claim 2, further comprising at least one resistor for said diode, said resistor being mounted on said carrier.

4. The combination of claim 2, wherein said housing includes a rear wall and said rear side is provided at said rear wall.

5. The combination of claim 4, wherein said rear portion of said sidewall has a rear edge face which is at least substantially flush with the rear side of said rear wall.

6. The combination of claim 1, wherein said securing means comprises at least one projection extending outwardly from said rear side and said support has an opening through which said projection extends.

7. The combination of claim 6, wherein said projection is hollow and said housing includes a rear wall, said rear side being provided on said rear wall and said projection extending rearwardly from said rear wall, said conductor means extending through said projection.

8. The combination of claim 7, wherein said housing further comprises a circumferentially complete sidewall and said projection is at least substantially parallel to the axis of said sidewall.

9. The combination of claim 1, wherein said housing comprises a rear wall and said rear side is provided on said rear wall, said rear wall constituting said carrier.

10. The combination of claim 1, wherein said housing has several apertures and contains a discrete diode behind each of said apertures.

11. The combination of claim 10, wherein said carrier is common to for said diodes.

* * * * *